United States Patent [19]

Bonifay

[11] 4,006,500

[45] Feb. 8, 1977

[54] STRETCHER HOLDER DEVICE FOR AMBULANCES

[76] Inventor: Andre Bonifay, 14 Bvd d'Athenes, Marseille 13001, France

[22] Filed: Mar. 13, 1975

[21] Appl. No.: 557,951

[52] U.S. Cl. ..... 5/82 R; 296/19

[51] Int. Cl.[2] ..... A61G 1/00

[58] Field of Search ..... 5/8, 82; 296/19

[56] References Cited

UNITED STATES PATENTS

| | | | |
|---|---|---|---|
| 874,159 | 12/1907 | Brusis | 296/19 |
| 2,276,236 | 3/1942 | Latimer | 5/8 |
| 3,348,245 | 10/1967 | Shindler | 5/82 |

FOREIGN PATENTS OR APPLICATIONS

| | | | |
|---|---|---|---|
| 484,113 | 4/1938 | United Kingdom | 296/19 |

*Primary Examiner*—James C. Mitchell
*Attorney, Agent, or Firm*—William Anthony Drucker

[57] ABSTRACT

A stretcher holder device, for use in vehicles such as ambulances or in the open or in buildings, has a frame with uprights and longitudinal cross-pieces which support individual stretchers. In a preferred arrangement the longitudinal cross-pieces define between them a central gap to receive and guide a stiffening base projecting at the underside of the stretchers. The stretcher holder frame can support a plurality of stretchers in stacked condition, with each stretcher spaced vertically from the next in the stack.

1 Claim, 6 Drawing Figures

STRETCHER HOLDER DEVICE FOR AMBULANCES

The subject of the invention relates to a stretcher holder for ambulances.

It is designed to allow maximum use of vehicle area by superimposing stretchers.

As things stand at present, in case of a major disaster for example, the rescue services generally have available an ambulance for two people lying side by side but not fastened inside the body of the vehicle and without any orthopedic support, and this may be during a long evacuation period.

The device in accordance with the invention eliminates these disadvantages in that it comprises a removable framework, adaptable to being fixed if so desired, making it possible to superimpose stretchers in layers, in no way hampering the administration of first aid but considerably increasing the transport capacity, these frames being capable of taking stretchers in the shape of a shell positioning the casualties and providing normal support.

It consists of a frame with uprights connected by longitudinal cross-pieces forming slides, and transverse stabilizing cross-pieces, and fixed to the floor and roof of the ambulance by suitable means. These uprights comprise supporting brackets on which ordinary stretchers, but preferably stretchers with a rigid enveloping shell, are held.

In the accompanying drawings, given as a non-limiting example of the forms of the embodiment of the subject of the invention:

Figure 1:
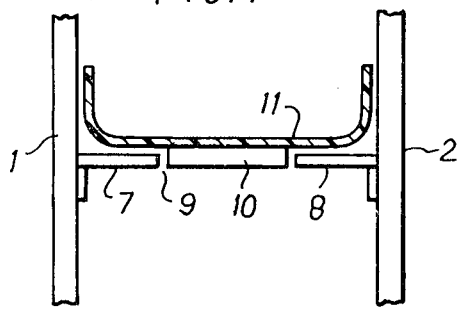
FIG. 1 shows a detail of the stretcher support
Figure 2:
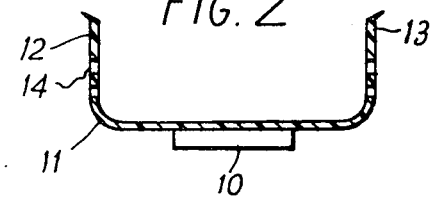
FIGS. 2 and 3 show sectional views of the shell stretchers
Figure 3:
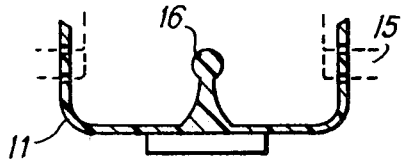
Figure 4:
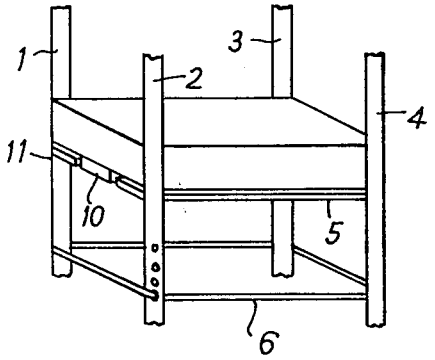
FIG. 4 is a view of the frame which can be adapted to ambulance vehicles
Figure 5:
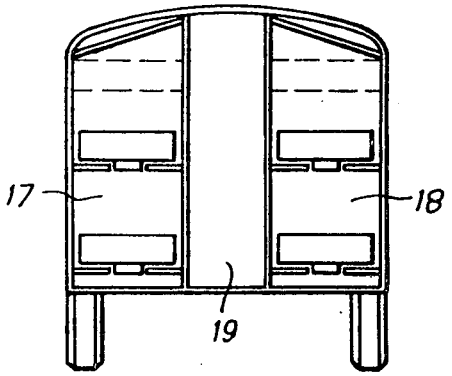
FIGS. 5 and 6 show the applications of the device.
Figure 6:
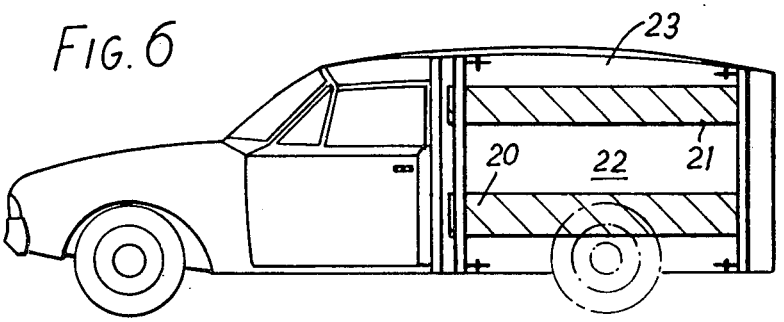

The framework (FIGS. 1, 4, 5, 6,) consists of uprights 1, 2, 3, 4 connected by cross-pieces 5, 6 to keep them rigid.

These cross-pieces are positioned on a level with the base of the stretchers in order not to hamper the administration of first aid. They also constitute horizontal slides.

Brackets 7, 8 are fixed at conventional heights, but can be movable and adjustable. In the middle they leave a gap to take a stiffening base 10 of a shell stretcher 11 equipped with enclosing walls 12, 13 with an aperture 14 for a strap 15, and a partition 16 forming a double trough for the legs.

The frames 17, 18 are placed in the ambulances which can thus transport four or six stretchers according to size and urgency.

The centre space 19 is sufficient for the ambulance man to move in, and for first aid to be administered.

The spaces 22 between the stretchers 20, 21 leave sufficient air and allow freedom of movement for any first aid.

These removable chassis or frames can be used to keep stretchers in storerooms, and they can be installed immediately on any ambulance floor. They can also be installed as fixed elements in ambulances, but have the advantage that in case of need, they transform the floor of any lorry or truck into an ambulance vehicle.

The superimposed housings vary in number according to the heights available and they are arranged in the direction of the vehicle's movement, being brought in through the rear door.

Nevertheless the shapes, dimensions and arrangement of the different components may vary within the limits of the equivalents, as may the materials used to make them, without thereby altering the general concept of the invention just described.

I claim:

1. A stretcher and holder assembly comprising:

i. a frame including four parallel uprights, ii. a respective plurality of parallel longitudinal cross-pieces connecting each pair of said uprights at each of the sides of the frame, iii. a respective plurality of parallel transverse cross-pieces connecting each pair of said uprights at each of the two ends of the frame, iv. a plurality of pairs of brackets disposed in vertical spaced relationship with one bracket of each pair secured on the pair of uprights at a respective side of the frame, the brackets of each pair being in the same plane and defining between them a longitudinal gap, said brackets being releasably secured on the respective uprights and adjustable along said uprights, v. means for securing the ends of the uprights to the roof and floor of an ambulance, and vi. at least one stretcher in the form of an elongated trough of rigid material, said stretcher including a longitudinal partition upstanding centrally for a part of its length to define in the stretcher trough a pair of zones to receive the legs, said stretcher including a longitudinal base member narrower than the trough width projecting downwardly from the trough along the entire length of the trough centrally thereof and serving to stiffen the trough, said stretcher being supported on a respective pair of said brackets with its longitudinal base member disposed in said longitudinal gap.

* * * * *